United States Patent [19]

Shah et al.

[11] Patent Number: 4,912,823

[45] Date of Patent: Apr. 3, 1990

[54] METHOD AND APPARATUS FOR FEEDING AND INDEXING A CONNECTOR

[75] Inventors: Hasmukh Shah, Wheaton; Henry Zielke, Hoffman Estates; Richard L. Patterson, Riverside; Thomas P. Pellegrino, Lisle, all of Ill.

[73] Assignee: Molex Incorporated, Wellington Court, Ill.

[21] Appl. No.: 371,470

[22] Filed: Jun. 19, 1989

Related U.S. Application Data

[62] Division of Ser. No. 241,286, Sep. 7, 1988.

[51] Int. Cl.[4] ..... H01R 43/04

[52] U.S. Cl. ..... 29/33 M; 29/564.1; 29/748; 29/759; 29/857

[58] Field of Search ..... 29/564.1, 748, 747, 29/759, 429, 854, 857, 33 M, 566.2, 564.4, 564.6, 753

[56] References Cited

U.S. PATENT DOCUMENTS

| | | | |
|---|---|---|---|
| 2,765,468 | 10/1956 | Cootes et al. | 29/566.2 |
| 4,389,769 | 6/1983 | Casey | 29/759 X |
| 4,493,147 | 1/1985 | Bakermans | 29/748 X |
| 4,590,650 | 5/1986 | Brown et al. | 29/33 M |
| 4,660,279 | 4/1987 | Szumierz et al. | 29/747 X |
| 4,754,536 | 7/1988 | Goyert et al. | 29/564.1 X |

FOREIGN PATENT DOCUMENTS

| | | | |
|---|---|---|---|
| 105045 | 3/1983 | European Pat. Off. | 29/748 |

*Primary Examiner*—William Briggs

*Attorney, Agent, or Firm*—Louis A. Hecht; Stephen Z. Weiss

[57] ABSTRACT

A termination machine for inserting wires into insulation displacement slots of terminals of an electrical connector. During each termination stroke, a connector locating member moves together with the termination blade to precisely position the connector for termination. A wire locator moves together with the termination blade and moves the wire into a guide slot in a template over the connector. When the blade, the wire and the connector are in precise alignment, the termination blade completes the termination stroke. A feed slide and pawl system moves the connector in steps equal to the terminal centerline spacing, and the feed stroke is selectively adjusted to skip voids where terminals are not to be terminated.

11 Claims, 11 Drawing Sheets

METHOD AND APPARATUS FOR FEEDING AND INDEXING A CONNECTOR

This is a division of copending U.S. patent application Ser. No. 241,286 filed Sept. 7, 1988.

FIELD OF THE INVENTION

The present invention relates to termination of electrical connectors and more particularly to improvements in apparatus and methods for applying wires to connectors having insulation displacement terminals.

DESCRIPTION OF THE PRIOR ART

Insulation displacement connectors have the advantage that the insulation does not need to be stripped from the metal conductor of a wire before termination. Such connectors have insulation displacement slots into which wires are forced. The walls of the slots displace the insulation and contact the metal conductors.

Many insulation displacement connectors include an array or row of terminals disposed in a series of cavities in a connector housing. The cavities and the terminals are arrayed in a regular pattern having a predetermined centerline spacing. Conforming with a trend toward miniaturization, the centerline spacing between adjacent terminals of insulation displacement connectors is decreasing. Similarly, smaller wire gauges are being used with insulation displacement connectors. These trends result in problems in accurately positioning a wire and a terminal slot relative to one another so that the wire is successfully terminated by the termination blade of terminating apparatus. If the wire and the slot are not accurately positioned relative to the termination tool, the wire may not be forced into the terminal slot or the terminal may be improperly deformed by the tool.

On type of termination apparatus used for insulation displacement connectors operates to terminate a single wire into a terminal during each operating cycle. Connectors are fed in steps to position each cavity of the connector housing in registration with the terminating tool. Often it is desired that no wire be applied to selected cavities or terminals. In addition, a series of connectors may be fed end-to-end through the terminating apparatus with a space between adjacent end cavities of two connector housings equal to twice the terminal centerline spacing. In such instances, referred to as voids, the termination apparatus cycles through a wasted step since the connectors are advanced in centerline spacing increments. These wasted cycles of operation add up to significant waste in production.

U.S. Pat. No. 4,724,609 discloses a single step terminating machine for insulation displacement terminals using a spring loaded indexing pawl mechanism cooperating with a cam arm on the termination head to index the connector one slot at a time through a termination station. U.S. Pat. Nos. 4,389,769 and 4,575,932 disclose hand held tools including spring loaded pawl indexing mechanisms for advancing electrical connectors one step at a time through a termination station. U.S. Pat. No. 4,043,017 discloses a termination tooling assembly incorporating a spring loaded wire hold down block for moving wires to a precise alignment position immediately prior to termination, as well as a different arrangement including a wire guide template with a roller for moving wires into template grooves to preposition the wires for termination.

SUMMARY OF THE INVENTION

It is a principal object of the present invention to provide improved apparatus and methods for terminating wires to electrical connectors and for accurately positioning the connectors relative to the wires and termination tooling so that even fine wires and closely spaced terminals can consistently and successfully be terminated. Another principal object of the present invention is to provide a connector feeding system in which wasted machine cycle operations are avoided by adjustment of the connector feed stroke when voids are desired. Other objects of the invention are to provide improvements overcoming difficulties encountered with electrical connector terminating apparatus and methods used in the past.

In brief, terminating apparatus in accordance with the present invention uses a reciprocating drive member to move wires from a wire feed region into insulation displacement connectors each having a housing with multiple side-by-side cavities, terminals in the cavities and insulation displacement slots in the terminals. A wire termination tool is mounted on the drive member for movement along a termination path intersecting the wire feed region in response to movement of the reciprocating drive member. A connector feed system advances one of the connectors to position the slot of the terminal to be terminated in the termination path. The tool is movable in a termination stroke from an initial position into the terminal slot and in a return stroke back to the initial position. In accordance with the invention, the terminating apparatus includes a support member mounted upon the drive member. A connector locating member is carried by the support member. The locating member is spaced from the termination tool and engages the connector during the termination stroke prior to movement of the termination tool into the slot.

In brief, a connector feed system in accordance with the present invention is used in a connector terminating machine including reciprocating tooling for applying wires to connectors having terminals at a predetermined centerline spacing. The system includes a connector feed track in which connectors are supported for movement in a connector feed direction. A feed member is mounted for movement adjacent the feed track. The feed member is reciprocated alternately in a retraction stroke opposite to the connector feed direction and in a feed stroke in the connector feed direction. pawl means drivingly engages the connectors with the feed member during the feed stroke and releases the connectors from the feed member during the retraction stroke. The system includes feed stroke adjustment means coupled to the feed member for selectively altering the length of the feed stroke in at least one increment equal to the predetermined centerline spacing.

In brief, a method of terminating electrical connectors in accordance with the present invention is carried out by moving an electrical connector to position an insulation displacement slot of a terminal approximately in alignment with a termination tool A wire is positioned between the termination tool and the slot. A drive member is moved in a termination stroke from a rest position toward the connector. The drive member supports both the termination tool and a locating member. The wire is forced into the slot with the termination tool and before the wire is forced into the slot, the connector is contacted with the locating member during the drive stroke accurately to position the slot in alignment with the termination tool.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE PREFERRED EMBODIMENT

Figure 1:
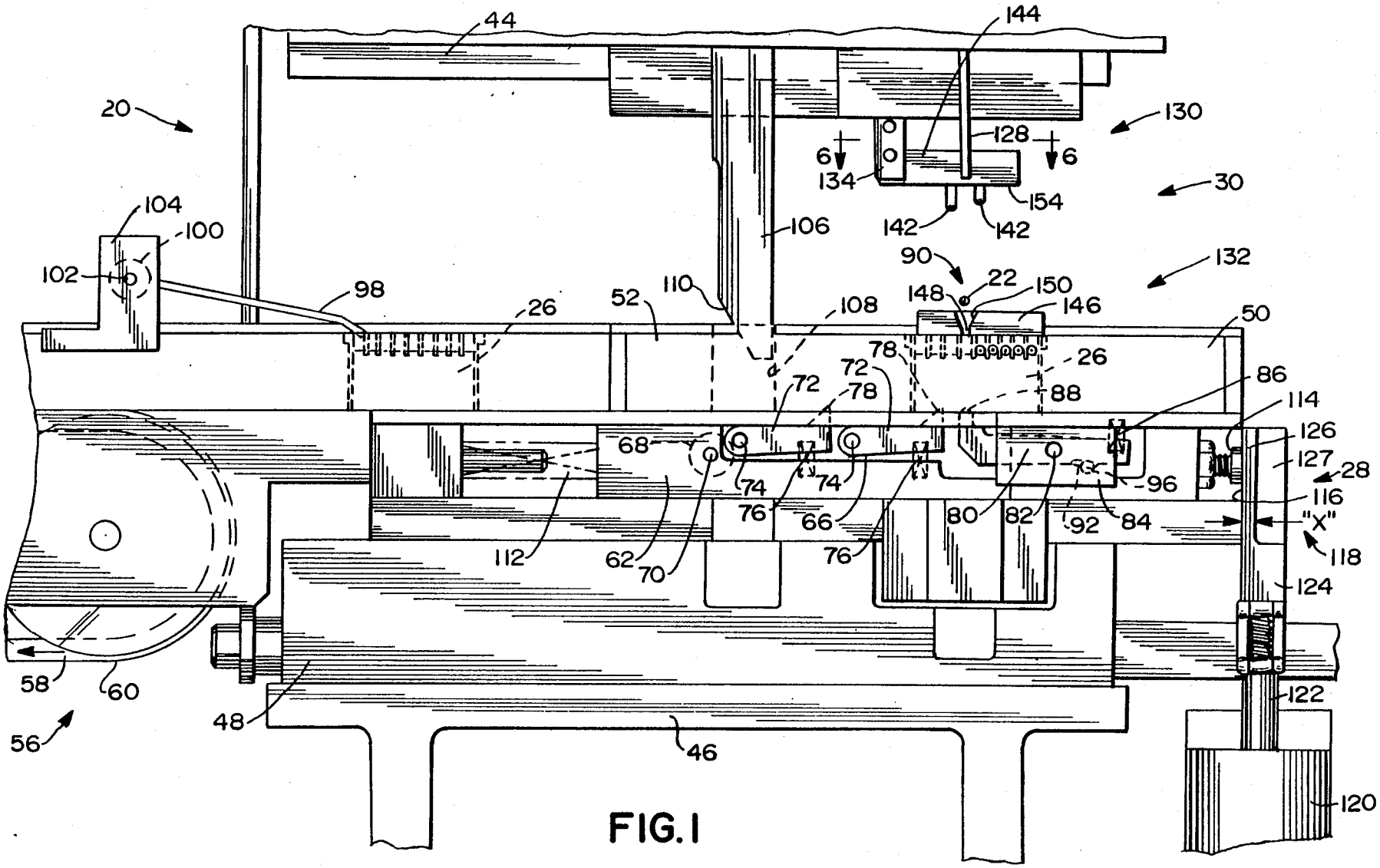
FIG. 1 is a fragmentary and partly diagrammatic front view of an electrical connector terminating machine embodying the present invention.

Referring to the drawings, FIG. 1 is a front elevational view of a termination machine generally designated as 20 and constructed in accordance with the principles of the present invention. The machine 20 applies wires 22 one at a time to electrical terminals 24 of insulation displacement electrical connectors 26. In general, the machine 20 includes a connector feed system 28 for advancing connectors 26 one step at a time through the machine 20 and a terminating assembly generally designated as 30 for accurately positioning terminals 24 and wires 22 while inserting wires 22 into insulation displacement slots 32 of the terminals 24.

Figure 9:
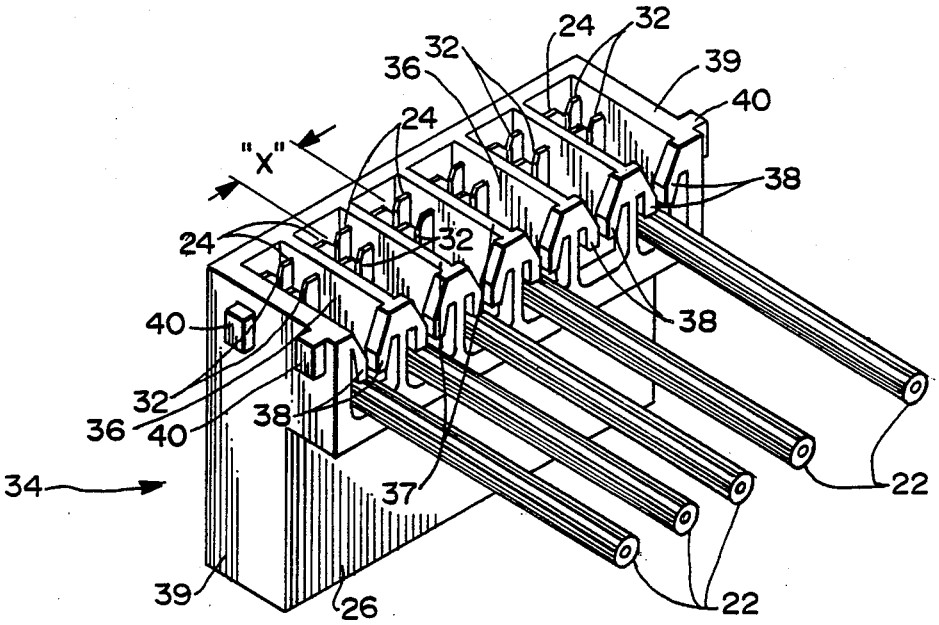
FIG. 9 is a perspective view of an electrical connector terminated with the termination machine of FIG. 1.

One connector 26 is illustrated in FIG. 9 after being terminated to wires 22 in the machine 20. The connector includes a molded plastic housing 34 defining a row of cavities 36 extending between the top and bottom of the housing 34 and separated by walls 37. Within each cavity 36 is one terminal 24 having aligned insulation displacement slots 32 directed upwardly toward the open tops of cavities 36. The top of the front wall of housing 26 is provided with a pair of strain relief or wire trap wings 38 at the entrance to each cavity 36. Terminated wires 22 are received in slots 32 with their metal conductors in electrical contact with terminals 24 and the wires are held beneath the wings 38.

The terminals 24 are arranged in a regularly spaced row with their centerlines spaced apart by identical distances. For example, the centerline spacing of terminals 24, corresponding to the distance between each pair of slots 32, may be in the neighborhood of 0.100 inch. This centerline spacing is indicated by the dimension "X" in FIG. 9. Both end walls 39 of the housing 34 are provided with spacer projections 40. When two housings are placed end-to-end, the projections 40 provide for a spacing distance between slots 32 of end terminals of two connectors equal to twice the centerline spacing. The invention is also applicable to other housing configurations, including those stackable end to end with centerline spacing maintained.

Figure 3:
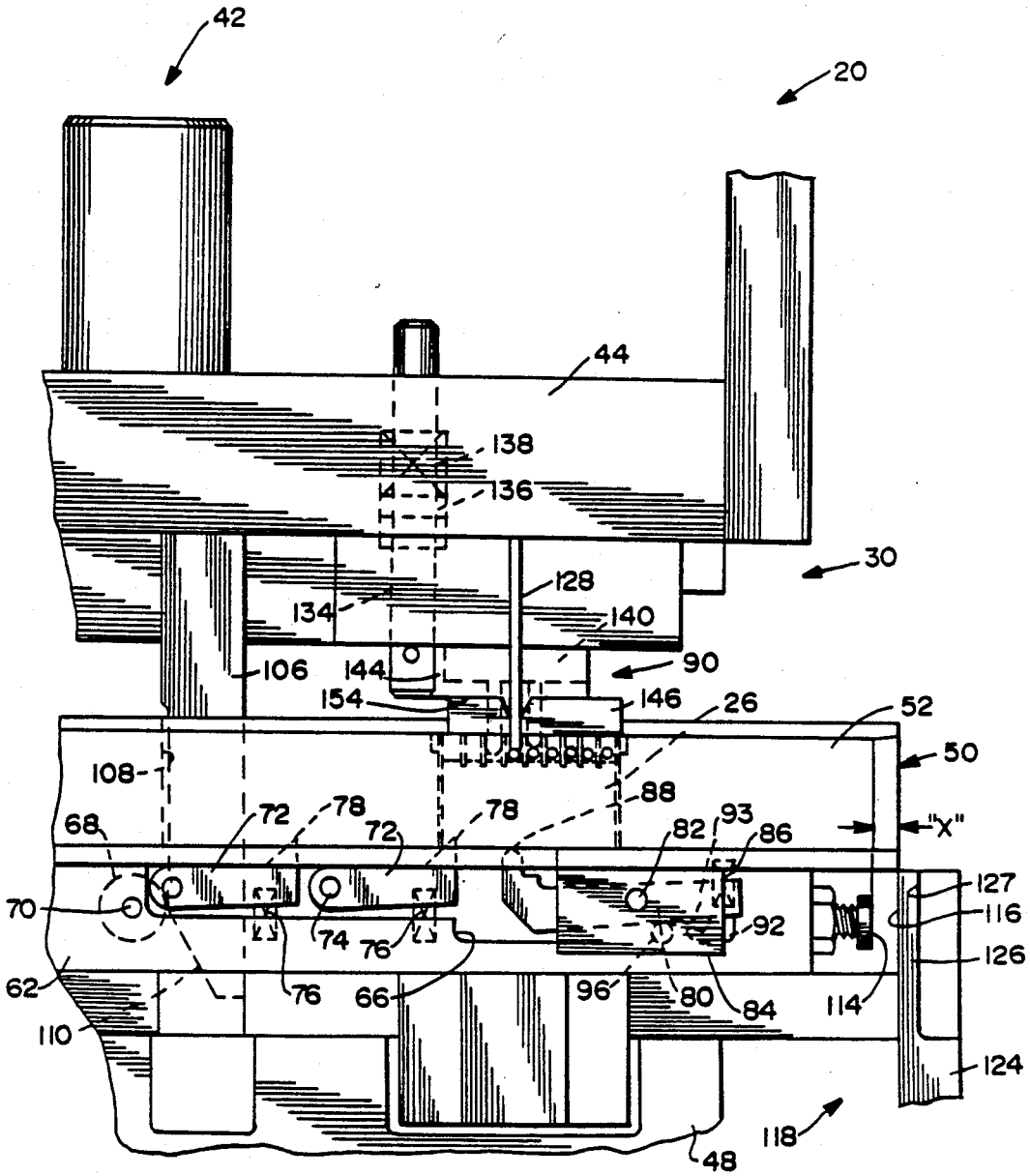
FIG. 3 is an enlarged view similar to a portion of FIG. 1 illustrating the termination machine at the end of a termination stroke.

Machine 20 is adapted to operate repetitively within a reciprocating press 42 indicated diagrammatically in FIG. 3. An upper tool holder or drive member 44 is moved down and then up in each cycle of machine operation relative to a fixed mounting plate 46 supporting an adaptor 48. The reciprocating press 42 and its provisions for mounting of components of the machine 20 therein may be of any conventional type well known to those skilled in the art.

Connector feed system 28 includes a connector feed track 50 defined between guide rails 52 and 54 extending across the width of machine 20. A connector supply assembly 56 supplies a series of end-to-end connectors 26 to the feed track 50 and continuously urges them in a connector feed direction, to the right as illustrated in FIG. 1. The connector supply assembly includes a friction drive belt 58 engageable with the bottoms of connectors 26 and movable in an endless path defined in part by a pulley 62. Terminated connectors 26 exit from the end of the feed track 50, to the right as illustrated in FIG. 1.

Figure 10:
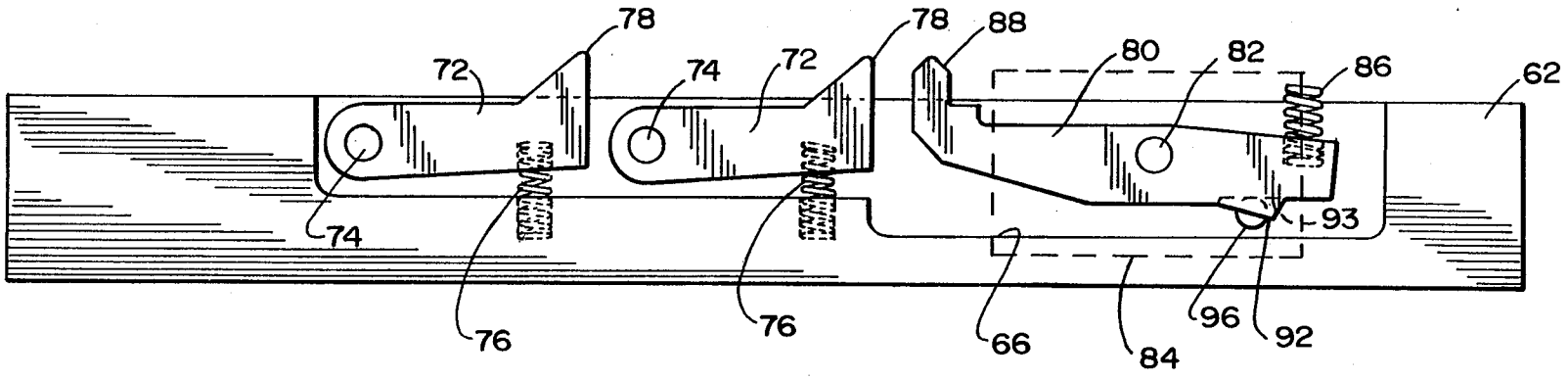
FIG. 10 is a front elevational view of the feed slide assembly of the machine of FIG. 1 on an enlarged scale.
Figure 11:
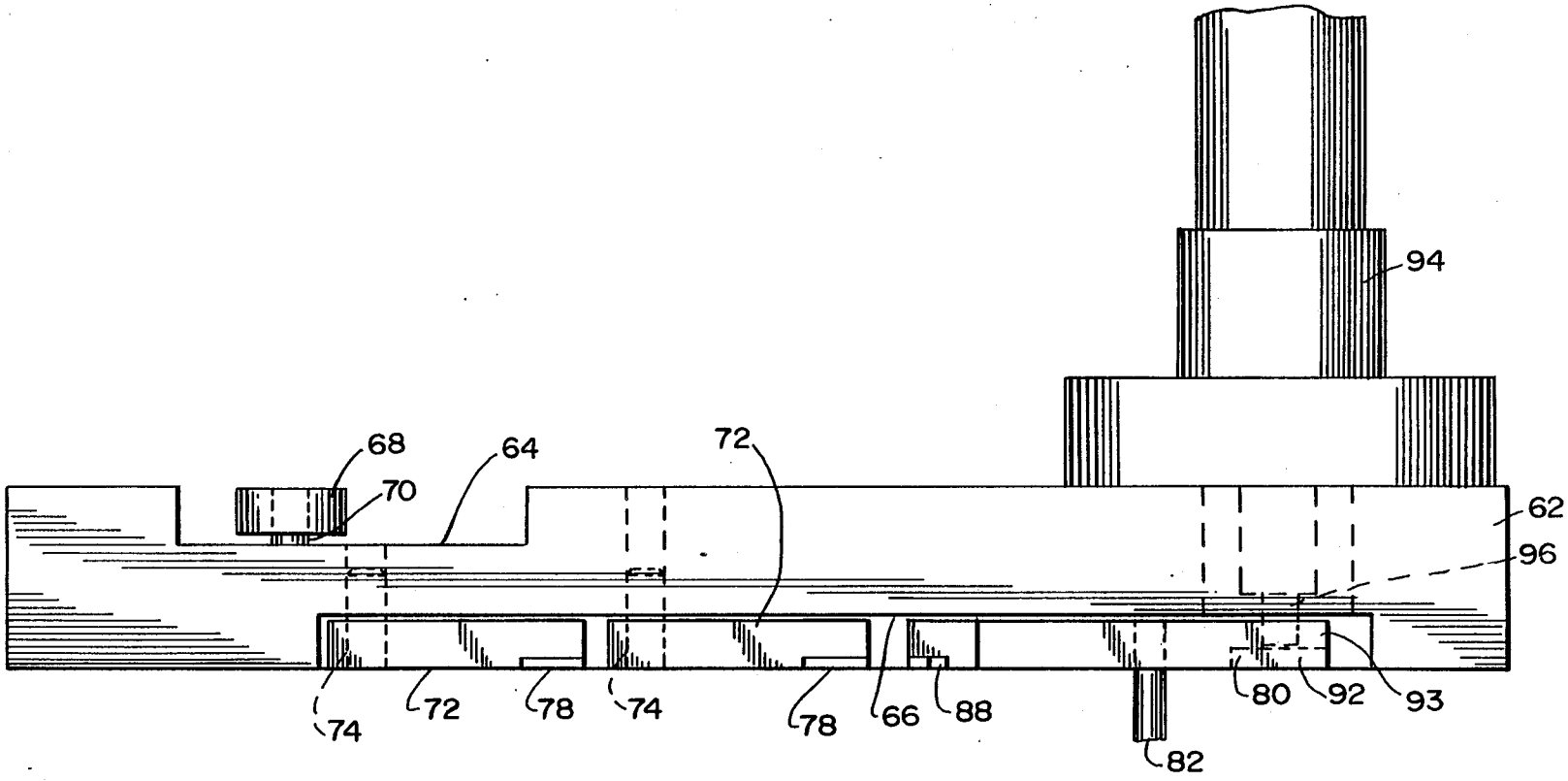
FIG. 11 is a top view, partly broken away, of the feed slide assembly.

A feed slide 62 is captured for sliding reciprocal movement beneath the connector feed track 50. As best seen in FIGS. 10 and 11, the feed slide 62 takes the form of an elongated body having recesses 64 and 66 on opposite sides. A cam follower 68 is supported by a pin or shaft 70 within the recess 64. Within one segment of recess 66 a pair of feed pawls 72 are pivotally supported by pins 74. Springs 76 urge feed pawls 72 to an upper position in which noses 78 of the pawls extend into the connector feed track 50 to engage the lowermost portions of cavities 36 of the connector housings 34.

A forward segment of the recess 66 provides clearance for a locking pawl 80 pivoted upon a pin 82 mounted in a pivot block 84 (FIG. 1) secured to the fixed portion of machine 20. A spring 86 captured between the locking pawl 80 and the lower portion of the connector feed track 50 urges a nose portion 88 of the pawl upwardly into the connector feed track 50 at a termination station 90.

Figure 13:
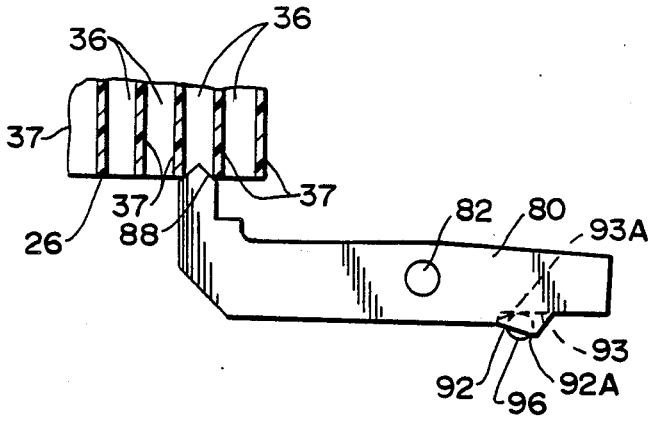
FIG. 13 is a diagrammatic side view showing the locking pawl and cam follower in a normal or standby position.
Figure 14:
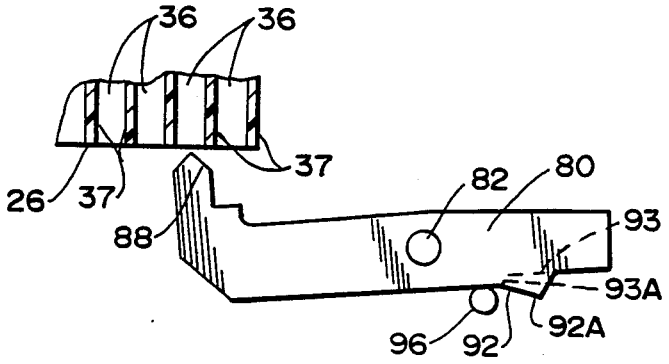
FIG. 14 is a view similar to FIG. 13 illustrating the locking pawl and cam follower in a cocked position prior to a feed stroke.
Figure 15:
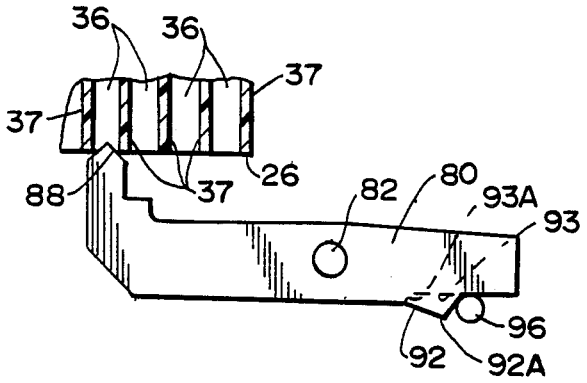
FIG. 15 is a view similar to FIG. 13 illustrating the locking pawl and cam follower at the end of a double feed stroke.

The lowermost portion of the locking pawl 80 is provided with a pair of side by side cam surfaces 92 and 93. A fluid operated locking pawl cylinder 94 is secured to the feed slide 62. A cam follower 96 is moved between two alternate positions by operation of cylinder 94. In the normal, retracted position (FIGS. 1 and 13) the cam follower 96 engages cam surface 93. When locking pawl cylinder is operated to extend the cam follower 96 (FIG. 14) the cam follower 96 engages the cam surface 92. In the normal or standby position of FIG. 1, cam follower 96 is retracted and nose portion 88 of the locking pawl 80 is held by spring 86 in engagement with a connector 26 in the connector feed track 50.

Connectors 26 within the connector feed track 50 are prevented from moving in the reverse direction opposite to the connector feed direction by an antibackup pawl 98. Pawl 98 is a thin, wirelike element secured to a hub 100 freely rotatable upon a pin 102 secured by a support 104. Pawl 98 rests due to gravity upon the upper portions of connectors 26 in order to prevent reverse movement (to the left as viewed in FIG. 1) while permitting free forward movement in the connector feed direction.

Figure 2:
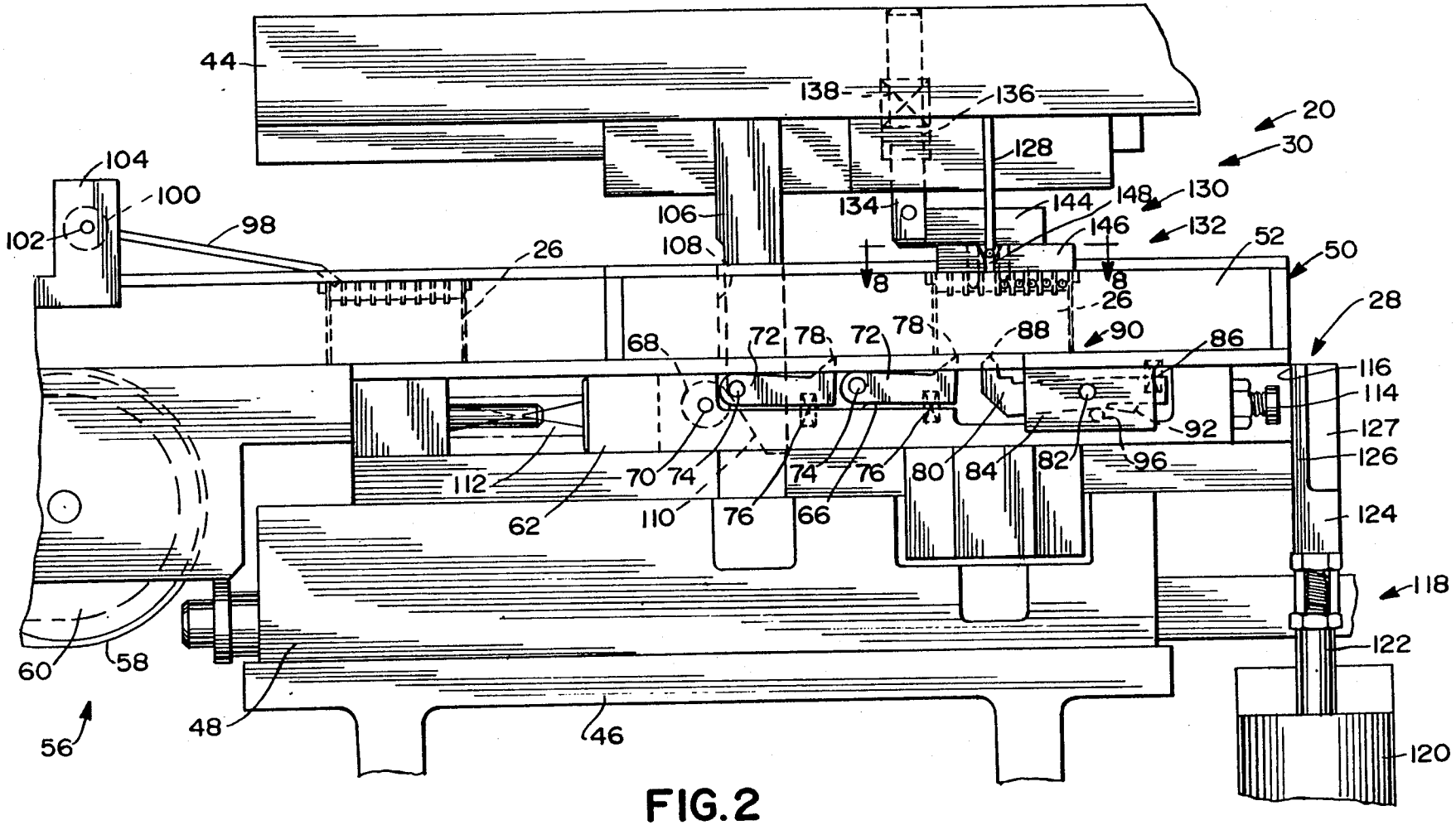
FIG. 2 is a view similar to FIG. 1 showing the termination machine in the midst of a termination stroke.

Each time that machine 20 carries out a cycle of operation, the connectors 26 in the feed track 50 are advanced to move a terminal 24 to the termination station 90. A feed cam 106 is supported by the drive member 44 and extends into an aperture 108 leading to the recess 64 in the feed slide 62. As the press 42 closes in a termination stroke, a cam surface 110 on cam 106 engages the cam follower 68 and moves the feed slide 62 in a retraction or cocking stroke against the force of a biasing spring 112. As indicated in FIG. 2, as the feed slide 62 retracts, the feed pawls 72 retract due to engagement with the connector housings 34. At the end of the retraction stroke of the feed slide 62, the noses 78 of the pawl 72 are moved upwardly by springs 76 to engage cavities 36 of connectors 26. The antibackup pawl 98 prevents connectors 26 from moving opposite to the connector feed direction during retraction of the feed slide 62.

During the retraction stroke of the feed slide 62, the terminating system 30 operates to insert a wire 22 into slots 32 of a terminal 24. Locking pawl 80 is initially urged by pawl spring 86 into engagement with the cavity 36 of connector housing 34 within which the terminated terminal is located. As the feed slide 62 moves in the retraction direction, the cam follower 96 moves along the cam surface 93 of the locking pawl 80 from the position shown in FIG. 13 to the position of FIG. 14. During the final part of this movement, the cam follower 96 engages a sloping cam segment 93A to pivot the locking pawl 80 against the force of the spring 86. This withdraws nose 88 from the feed track 50 in preparation for a connector feed stroke.

As the reciprocating press 42 opens following a termination stroke, the feed cam 106 moves upwardly in aperture 108, and cam surface 110 moves clear of the cam follower 68. Spring 112 moves the feed slide 62 in a feed stroke in the connector feed direction (to the right as illustrated in FIG. 1). Feed pawls 72 cause the connectors 26 in the feed track 50 to move together with the feed slide 62. During this feed stroke, the cam follower returns from the position of FIG. 14 to the position of FIG. 13. As a connector 26 is advanced one step in position for a subsequent termination stroke, the cam follower 96 moves across the cam segment 93A and spring 86 moves the nose 88 into the feed track 50 to hold connector 26 in position at the termination station 90.

In accordance with a feature of the present invention, the feed system 28 can be selectively operated to prevent wasted cycles of the machine. It may be desirable to have voids in a connector such as that illustrated in FIG. 9 where one cavity 36 of the housing 34 is not provided with a wire 22. In addition, an extra and unused centerline space distance is encountered following the last terminal 24 of each connector 26. A feed stroke adjustment mechanism generally designated as 118 avoids the necessity for wasted machine cycles when voids are encountered.

Adjustment mechanism 118 includes a fluid operated stroke adjustment cylinder 120 including a piston rod 122 attached to a movable stop member 124 having a blade portion 126 upon which the stop 116 is defined. Blade portion 126 is equal in thickness to the centerline spacing distance "X" between adjacent terminals 24 of the connectors 26.

Figure 12:
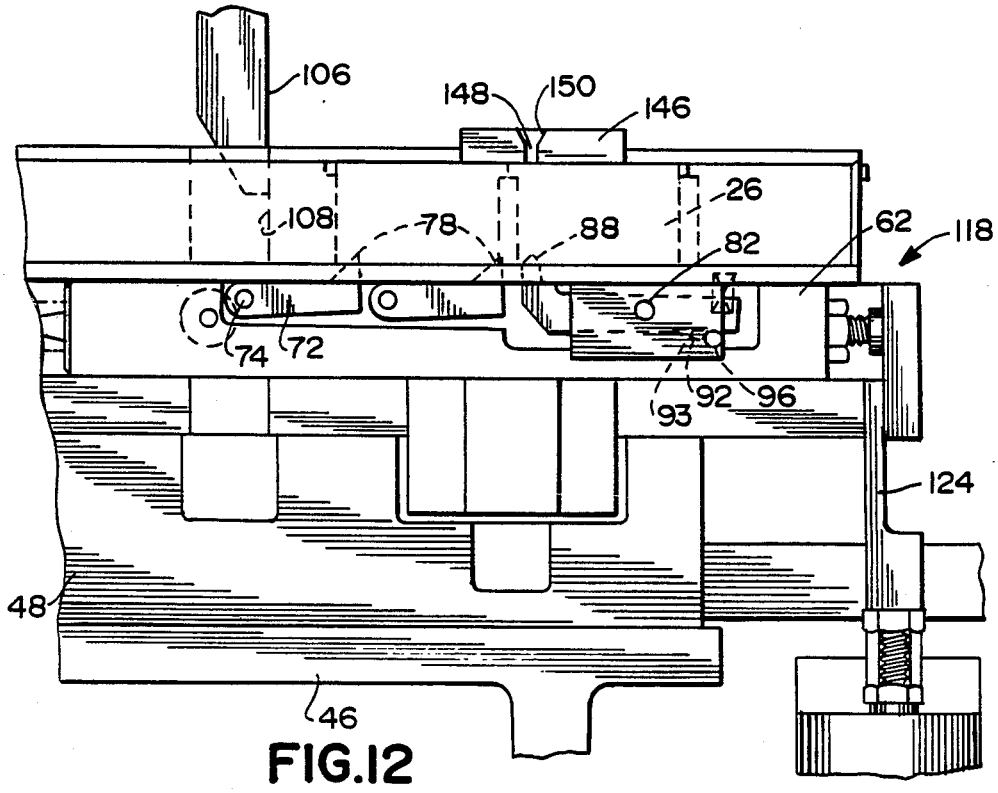
FIG. 12 is a front view similar to part of FIG. 1 illustrating the end of a feed stroke when the termination machine is operated to skip a void.

The end limit of movement of the feed slide 62 in the retraction direction is defined by interaction of cam surface 110 with the cam follower 68 and is consistent for every retraction stroke. The limit of movement of the feed slide 62 in the connector feed direction is determined by engagement of the abutment 114 with the stop 116 when the stop member 124 is in an upper position illustrated in FIG. 1. This distance is equal to the normal centerline spacing. When a void is encountered, the cylinder 120 is operated to retract the stop member 124 and uncover a fixed secondary stop 127 (FIG. 12). Since the blade portion 126 has a thickness equal to one centerline spacing, retraction of member 124 increases the feed stroke to a distance equal to two centerline spacings. Thus, the connectors 34 are stepped a distance of two centerline spacings when member 124 is retracted. During the following cycle of operation, cylinder 120 is operated to raise the member 124 to the normal position illustrated in FIG. 1 so that the following cycle results in a movement of a single centerline spacing.

The locking pawl cylinder 94 and cam surface 92 also constitute part of the adjustment mechanism 18. At the end of a retraction stroke, the locking pawl 80 and cam follower 96 are in the positions shown in FIG. 14. To prepare the feed system 28 for a double length feed stroke, cylinder 96 is operated prior to the feed stroke to extend cam follower 96 into engagement with cam surface 92. During the feed stroke, cam follower 96 moves across an elongated cam projection 92A. This holds the locking pawl nose 88 in its retracted position until the final part of a double step feed stroke. Following this feed stroke, the cylinder 94 is operated to retract cam follower 96 to its normal position in engagement with cam surface 93.

Terminating system 30 includes a termination blade 128 secured to the tool holder or drive member 44. During each termination stroke of the machine 20, the blade 128 moves downwardly into engagement with a wire 22 placed in a wire feed region at the termination station 90. Wire 22 may be placed into this region in any suitable manner such as manually or preferably by known wire cutting and feeding apparatus (not shown). Continued downward movement of termination blade 128 forces wire 22 into the insulation displacement slots 32 of connector 26 and through the strain relief wings 38 associated with each cavity 36 of the connector housing 34.

In accordance with the present invention, the terminating system 30 also includes a connector positioning assembly generally designated as 130 and a wire locating assembly generally designated as 132. Assemblies 130 and 132 function during each termination stroke to assure that the insulation displacement slots 32, the wire 22 and the termination blade 128 are accurately aligned with one another for proper termination of the wire.

Figure 5:
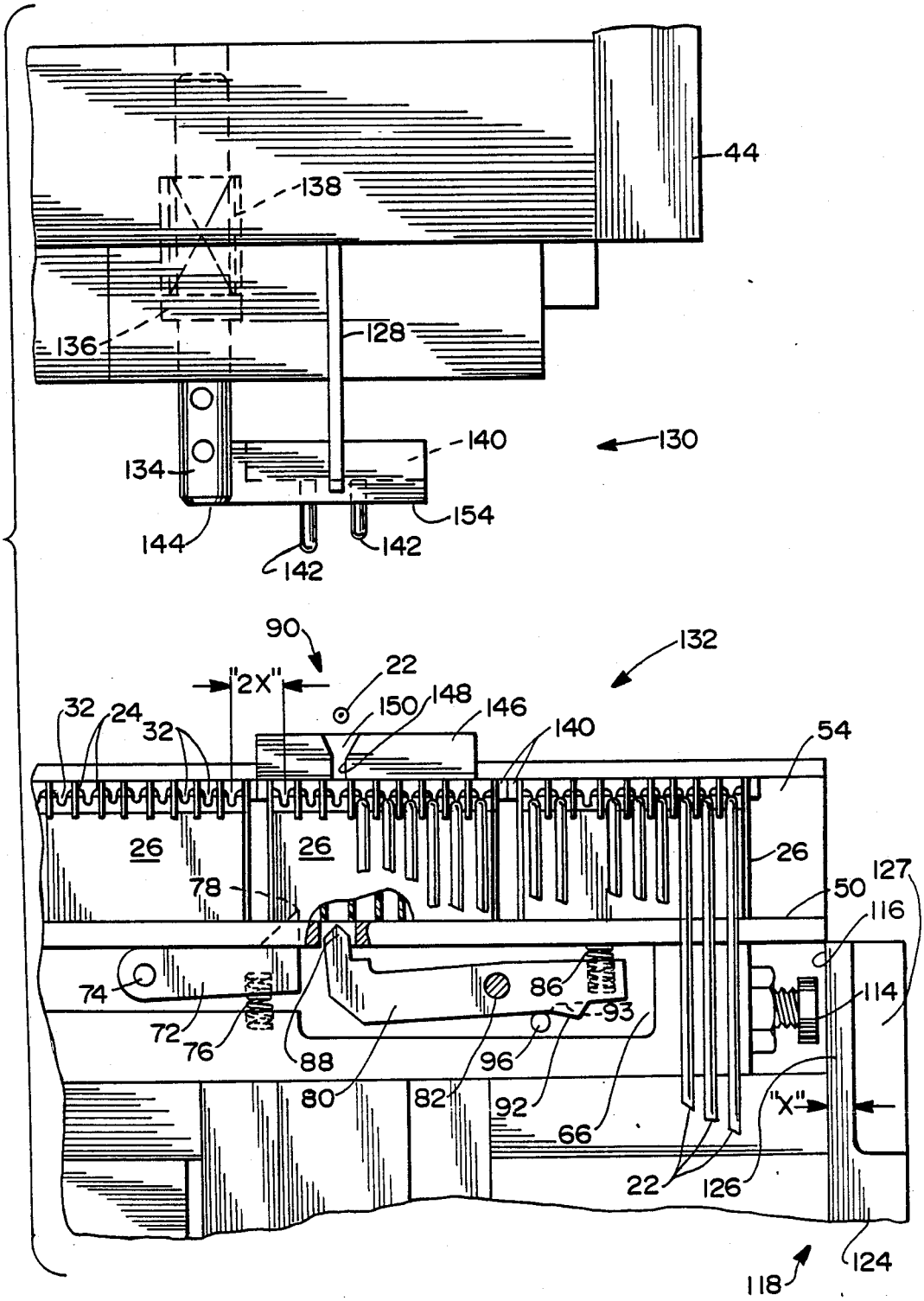
FIG. 5 is an enlarged fragmentary front view of the termination machine illustrating retraction of the locking pawl during a connector feed stroke.
Figure 6:
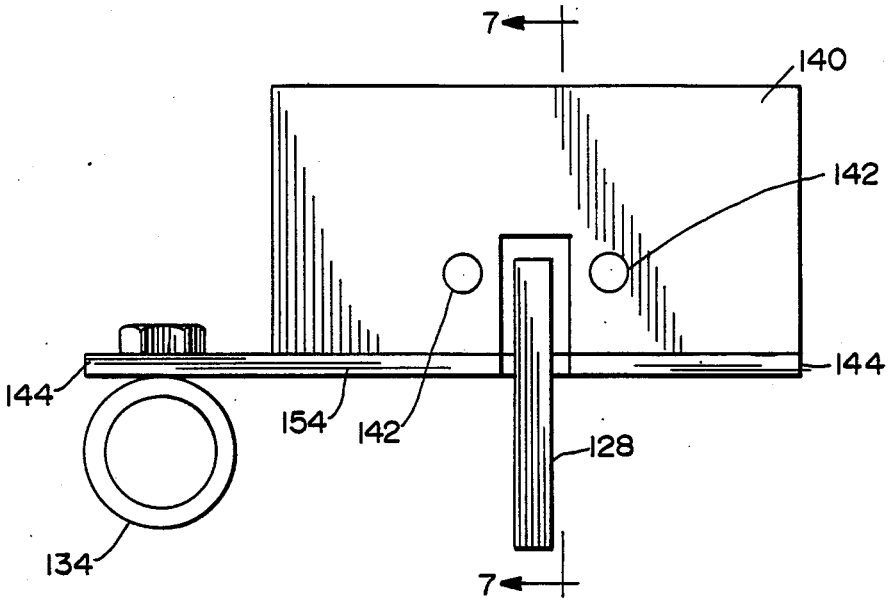
FIG. 6 is an enlarged sectional view of the termination assembly of the terminating machine taken along the line 6—6 of FIG. 1.

An actuator rod or support member 134 is carried by the drive member or tool holder 44 by a lost motion connection including a flange 136 and a spring 138 captured between the flange 136 and the drive member 44. Normally the rod 134 is in its lowermost position illustrated in FIG. 5. Spring 138 permits relative motion between rod 134 and the drive member 44 in the final portion of the termination stroke as can best be seen by a comparison of FIGS. 1 and 3.

Figure 8:
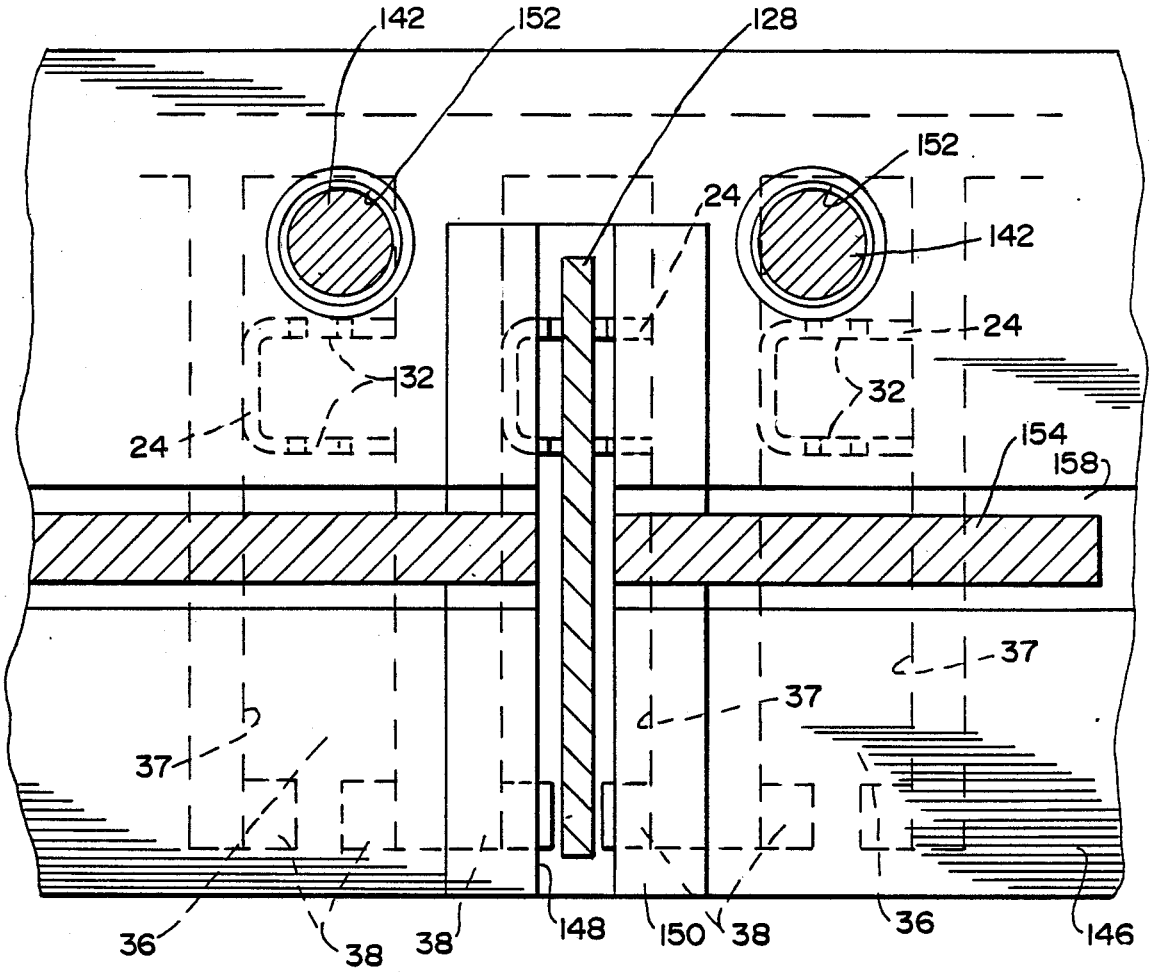
FIG. 8 is an enlarged sectional view taken along the line 8—8 of FIG. 2 and illustrating elements of the terminating assembly in registration with portions of an electrical connector.

Connector positioning assembly 130 includes a locator block 140 to which are fixed a pair of connector locating members or pins 142. Block 140 is attached to a wire centering blade 144 that is in turn attached to the actuator rod 134. As the actuator rod moves downwardly in a termination stroke, the pins 142 are received into cavities 36 of the connector housing 34. Specifically, as seen in FIGS. 8, pins 142 engage the walls 37 separating the cavity of the terminal to be terminated from adjacent cavities 36. This engagement provides a precise and fine adjustment of the position of the slots 32 of the terminal to be terminated. Since pins 142 engage the connector 26 before movement of the termination blade 128 into the connector 26, the housing is precisely positioned before the termination operation.

Engagement of pins 142 with the cavity interior side walls 37 or end walls 39 assures that accurate positioning is achieved both with terminals located toward the center of the connector and with terminals located in the endmost cavities. In each case the walls flanking the terminal to be terminated are contacted by pins 142. After pins 142 engage and precisely position the connector 26, further movement of blade 128 occurs while the pins 142 and locator block 140 remain stationary due to the lost motion spring 138. Pins 142 engage the connector 26 prior to the time that locking pawl nose 88 is retracted by cam follower 96 and cam surface 93. This assures that the position of the connector 26 is continuously controlled throughout the insertion stroke.

Wire locating assembly 132 includes a template or guide 146 located in a fixed position above the connector feed track 50. Guide 146 includes a wire guide slot 148 precisely aligned with and overlying the insulation displacement slots 32 of a connector precisely positioned at the termination station by the positioning pins 142. Slot 148 includes a bevelled entry portion 150. The template 146 also includes a pair of round bevelled clearance openings 152 (FIG. 8) permitting movement of the locating pins 142 through the template and into cavities 36 of the connector 26.

Figure 4:
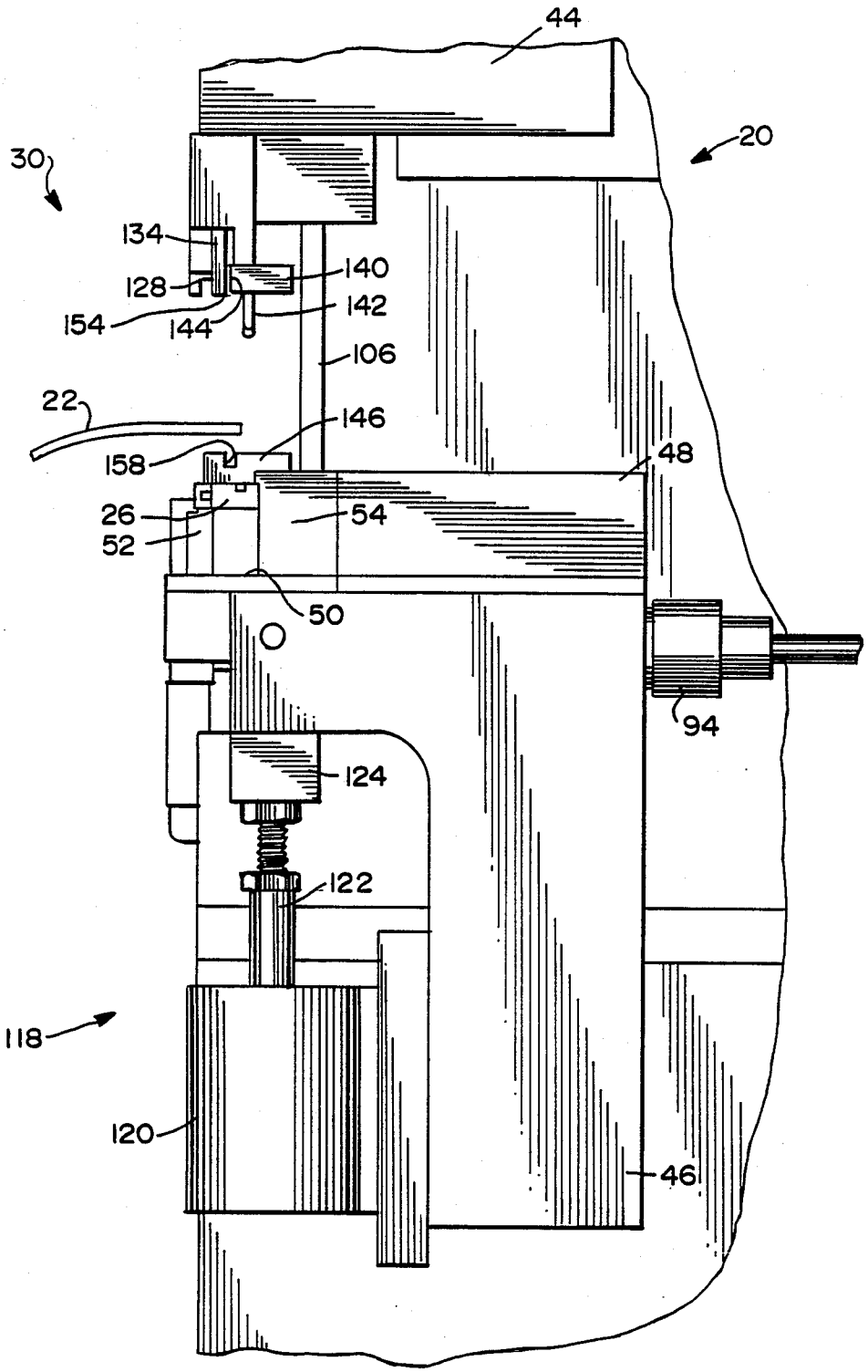
FIG. 4 is an end view of the termination machine taken from the right-hand end as viewed in FIG. 1.
Figure 7:
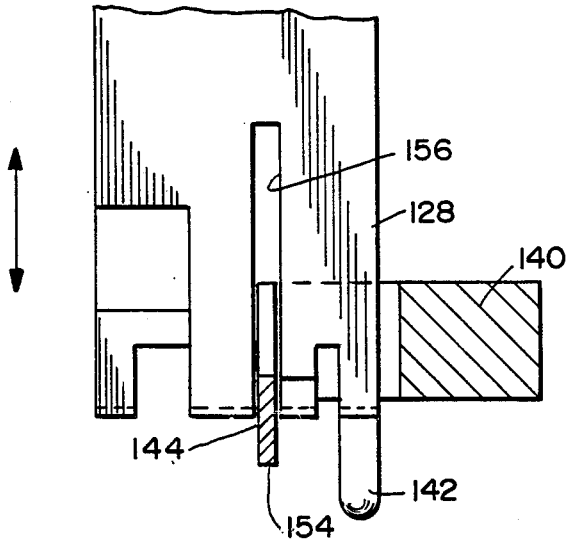
FIG. 7 is a sectional view taken along the line 7—7 of FIG. 6.

Wire locator blade 144 is generally L-shaped and includes a horizontally extending wire engaging portion 154 received in an upwardly extending slot 156 in termination blade 128 (FIG. 7). As the actuator rod 134 moves downwardly with blade 144, the horizontal portion 154 engages a wire 22 in the wire feed region. The wire 22 is forced downwardly into the bevelled entry 150 of the slot 148. Template 146 includes a grove or channel 158 (FIGS. 4 and 8) in which blade portion 154 seats at the downward limit of its movement. In this position, wire 22 is positioned in the neck portion of groove 148 directly below the termination blade 128 and directly above slots 32 of the precisely positioned terminal 24. When horizontal blade portion 154 seats in channel 158, this provides a stop preventing further downward motion of the connector positioning assembly 130. As the press 42 continues to close in a termination stroke, the termination blade moves through the last portion of its stroke to engage wire 22 in slot 148 and force it into terminal slots 32.

The method of terminating electrical connectors in accordance with the present invention is preformed during operation of the termination machine 20. The components of the machine 20 are shown between operating cycles in FIG. 1. A wire 22 is located in the wire feed region at the termination station 90 and the reciprocating press 42 is fully open. Abutment 114 is against stop 116 and feed slide 62 is located at the end of a feed stroke with the next terminal 24 to be terminated approximately positioned below termination blade 128. Locking pawl 80 is in engagement with the cavity 36 containing that terminal, and the retracted cam follower 96 engages cam surface 93.

A termination stroke is initiated when the drive member 44 begins its downward movement. Pins 142 move through openings 152 in the template 146 and engage walls 37 or 37 and 39 of cavities 36 of the connector housing 34 on opposite sides of the terminal 24 to be terminated in order precisely to position the terminal. Simultaneously, the locator blade portion 154 engages wire 22 and moves it into the wire guide slot 148 directly above the insulation displacement slots 32. When blade portion 154 seats in the channel 158, movement of the actuator rod 134, of the locator block 140 and pins 142, and of the wire locator blade 144 is stopped as seen in FIG. 2. Spring 138 then permits the termination blade to complete the termination stroke in which wire 22 is forced by the blade 128 into the slots 32 and the wire 22 is forced beyond the strain relief wings 38 (FIG. 3).

During the termination stroke, the cam surface 110 of the feed cam 106 engages the cam follower 68 on the feed slide 62 to retract the feed slide. The locking pawl 80 remains in engagement with the connector 26 during retraction of the feed slide 62 until the cam follower 96 in cooperation with segment 93A of cam surface 93 pivots the locking pawl 80 to withdrawn nose 88 from the feed track 50. Feed pawls 72 retract due to contact with connectors 26 and move opposite to the connector feed direction a distance equal to one centerline spacing. Reverse movement of the connectors 26 is prevented by the anti backup pawl 98.

In the return stroke following the termination stroke, the termination blade 128 moves upwardly to the rest position of FIG. 1. During the first part of this movement, the spring 138 expands. Thereafter, the actuator rod 134, the locator block 140 and pins 142, and the wire locator blade 144 are raised to their initial positions.

During the return stroke, the cam surface 110 releases the cam follower 68 and spring 112 moves the feed slide 62 in the connector feed direction in a feed stroke. During the final part of the feed stroke, the nose 88 of the locking pawl 80 returns to the feed track 50 to hold connector 26 in position with the next cavity 36 located at the termination station 90. The feed pawls 72 move the connectors 26 in the connector feed direction a distance equal to one centerline spacing if stop 116 is employed or a distance equal to two centerline spacings if stop 127 is employed.

While the invention has been described with reference to details of the illustrated embodiment, these details are not intended to limit the scope of the invention as defined in the appended claims.

We claim:

1. A connector feed system for use in a connector terminating machine including reciprocating tooling for applying wires to connectors having terminals at a predetermined centerline spacing, and feed system comprising:

a connector feed track for supporting connectors to be terminated for movement in a connector feed direction;

a feed member mounted for movement adjacent said feed track;

means for reciprocating said feed member alternately in a retraction stroke opposite to the connector feed direction and in a feed stroke in the connector feed direction; and pawl means for drivingly engaging the connectors with said feed member during said feed stroke and for releasing the connectors from the feed member during said retraction stroke;

the connector feed system being characterized by:

feed stroke adjustment means for selectively altering the length of said feed stroke in at least one increment equal to the predetermined centerline spacing.

2. A connector feed system as claimed in claim 1, said stroke adjustment means including stop means engageable by said feed member at the end of each feed stroke, and means for adjusting said stop means.

3. A connector feed system as claimed in claim 2, said stop means including a first stop member fixed in the path of said feed member and a second stop member movable into and out of the path of said feed member.

4. A connector feed system as claimed in claim 1, said means for reciprocating said feed member in the retraction stroke comprising cam means on the reciprocating tooling and cam follower means on said feed member.

5. A connector feed system as claimed in claim 4, said means for reciprocating said feed member in the feed stroke in the connector feed direction comprising spring means.

6. A method of terminating electrical connectors of the type including a row of cavities containing terminals with insulation displacement slots, said method comprising:

moving the connector to position the slot of a terminal approximately in alignment with a termination tool;

reciprocating a feed slide adjacent the connector in first and second directions, restraining the connector when the feed slide is reciprocated in the first direction, and coupling the connector to the feed slide when the feed slide is reciprocated in the second direction;

positioning a wire between the termination tool and the slot;

moving a drive member in a termination stroke from a rest position toward the approximately positioned connector, the drive member supporting both the termination tool and a locating member;

forcing the wire into the slot with the termination tool; and contacting the connector with the locating member during the drive stroke accurately to position the slot in alignment with the termination tool before the wire is forced into the slot.

7. A connector terminating machine for terminating wires into insulation displacement slots of terminals mounted in a row of cavities in a housing of an electrical connector, said insertion assembly comprising:

a termination station;

connector feed means for moving the connector to be terminated to said termination station;

said connector feed means including a connector feed slide mounted for reciprocal movement toward and away from said termination station, means for cocking said slide in response to movement of said termination blade in said termination stroke, means for releasing said slide to move in a feed stroke following said termination stroke, and first pawl means carried by said slide for advancing the connector relative to the termination station during said feed stroke;

a wire termination blade disposed adjacent said termination station;

blade drive means for moving said termination blade in a termination stroke in which a wire is inserted into the slot of one terminal of the connector;

connector positioning means for positioning the connector with the slot of the terminal in alignment with said termination blade during said termination stroke;

said connector terminating machine being characterized by:

said connector positioning means including a locating member movable by said blade drive means into contact with the connector during said drive stroke prior to insertion of a wire into the slot of the terminal of the connector.

8. A method as claimed in claim 6 wherein said reciprocating step includes moving the feed slide with a cam member supported by the drive member.

9. A connector terminating machine as set forth in claim 7 further comprising second pawl means for preventing reverse movement of the connector during cocking of said slide.

10. A connector terminating machine as set forth in claim 9 further comprising third pawl means engageable with the connector for locking the connector in the termination station after said feed stroke.

11. A connector terminating machine as set forth in claim 7 further comprising means for varying the length of said feed stroke for the purpose of skipping cavities in the connector housing or skipping between connector housings or the like, said varying means including a first stop engageable by said slide for limiting the feed stroke to a first distance corresponding to the distance between cavities of the housing, a second stop engageable by said slide for limiting the feed stroke to a second distance different from said first distance, and feed adjustment means for moving at least one of said stops out of the path of said slide.

* * * * *